US005340182A

United States Patent [19]

Busink et al.

[11] Patent Number: 5,340,182

[45] Date of Patent: Aug. 23, 1994

[54] SAFETY ELEVATOR

[75] Inventors: Cornelis L. Busink, Breda; Johannes W. H. van Rijzingen, Oosterhout; David B. Mason, Eindhoven, all of Netherlands

[73] Assignee: Varco International, Inc., Orange, Calif.

[21] Appl. No.: 941,233

[22] Filed: Sep. 4, 1992

[51] Int. Cl.[5] ..... E21B 19/06

[52] U.S. Cl. ..... 294/88; 294/90; 294/102.2; 294/110.1

[58] Field of Search ..... 294/86.1, 86.15, 86.27, 294/86.29, 86.33, 88, 90, 91, 102.2, 110.1, 907; 188/67; 414/22.51, 22.68

[56] References Cited

U.S. PATENT DOCUMENTS

| | | | |
|---|---|---|---|
| 1,599,144 | 9/1926 | Paulsen | 294/90 |
| 1,814,407 | 7/1931 | Peebles | 294/90 |
| 2,636,769 | 4/1953 | Cobb | 294/91 |
| 2,684,166 | 7/1954 | DeJarnett | 294/90 X |
| 2,692,059 | 10/1954 | Bolling | 294/110.1 X |
| 2,695,189 | 11/1954 | Chrisman et al. | 294/90 |
| 2,722,450 | 11/1955 | Nelson | 294/90 |
| 3,363,929 | 1/1968 | Nelson | 294/88 |
| 4,878,705 | 11/1989 | Arnquist | 294/907 X |

FOREIGN PATENT DOCUMENTS

| | | | |
|---|---|---|---|
| 319534 | 11/1971 | U.S.S.R. | 294/110.1 |

OTHER PUBLICATIONS

Brochure of Varco International, Inc. entitled "Varco BJ Air Operated Elevators" showing several prior art air operated elevators, Jan. 1990.

*Primary Examiner*—Johnny D. Cherry
*Attorney, Agent, or Firm*—William P. Green

[57] ABSTRACT

An elevator for supporting a string of pipe in a well rig is actuable between a closed condition for gripping of the pipe and an open condition, and includes a safety device for preventing opening of the elevator when a string of pipe is positioned in and supported by the elevator, to thus prevent accidental dropping of the string into a well. The elevator may be opened and closed by air pressure, with the safety device preferably including a sensing element positioned to respond to the presence of a well pipe in the elevator at a location to be supported thereby, and a valve actuable by the sensing element to control the delivery of pressure fluid to the elevator.

16 Claims, 6 Drawing Sheets

10
12
14
23
25
26
27
29
30
31
32
33
34
35
36
37
38
39
40
41
42
43
44
59
67
68
69
74
8
3
4

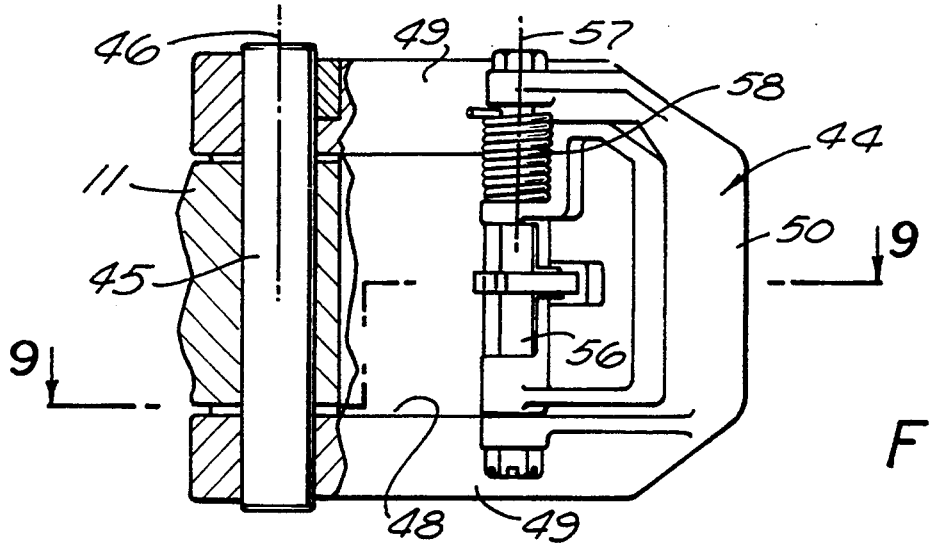
FIG. 8
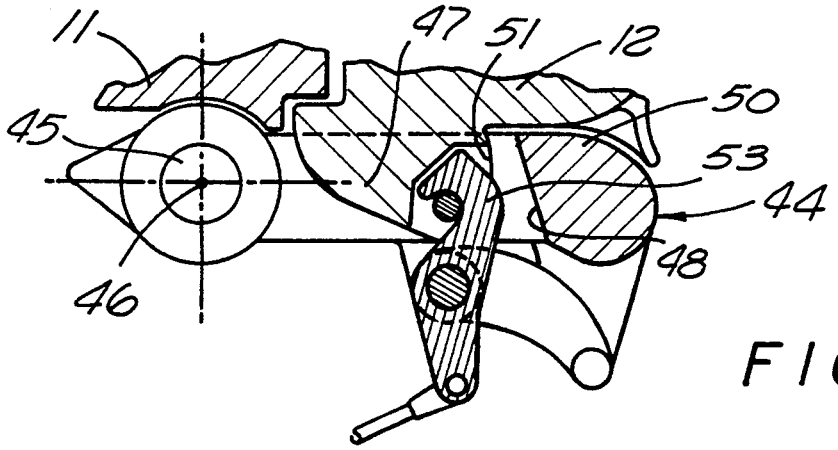
FIG. 9
FIG. 10
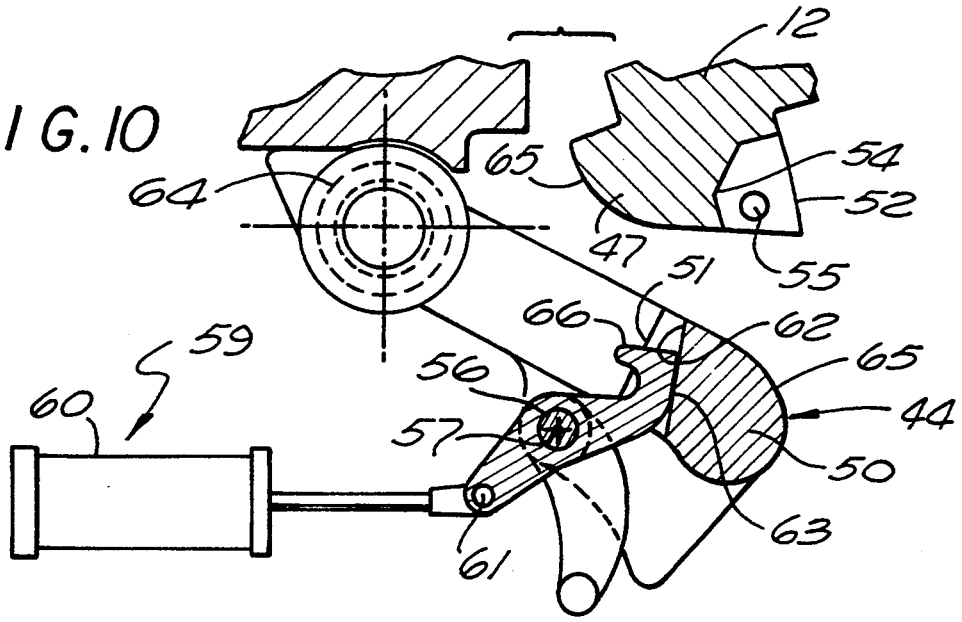

SAFETY ELEVATOR

This invention relates to safety devices for elevators utilized in suspending a string of drill pipe or other well pipe in a well rig.

BACKGROUND OF THE INVENTION

During the drilling of a well, and when performing various other operations in a well, it frequently becomes necessary to suspend the drill string or another string or length of pipe in the well by means of an elevator supported from the traveling block of the rig. In certain types of rigs, such as top drive arrangements, the efficiency and convenience of the overall pipe handling operation can be enhanced by employment of elevators which are actuated remotely between a closed condition for gripping and supporting the well pipe and an open condition in which the elevator can be moved laterally onto and off of the pipe. A known type of power operated elevator is actuated between these conditions by compressed air, which operates two cylinders, with the first cylinder opening and closing two body sections of the elevator, and the second cylinder actuating a latch for holding the body sections in closed condition.

SUMMARY OF THE INVENTION

The general purpose of the present invention is to provide a safety device for preventing accidental opening of an elevator when a pipe is supported by the elevator. As will be appreciated, opening of an elevator while it is holding a string of pipe can result in dropping of the entire string into the well, with possible major damage to the string and any equipment carried by or associated with the string, and to the well itself, and with possible injury to personnel and loss of time in fishing for and removing the string from the well and in other operations which may be required as a result of the unwanted opening of the elevator. The safety device for preventing these problems includes a sensing element which responds to the presence of a string of pipe in the elevator at a location to be supported by the elevator, and which automatically prevents opening of the elevator when a pipe is at that location. The sensing element preferably operates a valve which controls the delivery of actuating fluid to the elevator.

In certain forms of the invention, the sensing element is mounted for engagement with the outer surface of a well pipe located in the elevator, and is movable generally toward and away from the axis of the pipe to sense the diameter of the pipe surface engaged by the element. When a pipe having enlarged joint ends is supported in the elevator, the sensing element contacts the increased diameter external surface of one of those joint ends and automatically conditions the safety valve or other power controlling unit to prevent powered opening of the elevator. When the pipe is suspended in the rig by means other than the elevator, the sensing element engages a smaller diameter portion of the external surface of the pipe, and in that condition permits opening of the elevator. In elevators of the slip type, the sensing element may be positioned for upward and downward movement in accordance with upward and downward movement of a number of pipe gripping slip elements contained within the body of the elevator, so that when a pipe is supported in the elevator by the slips the resultant downward movement of the slips will actuate the safety valve or other unit for preventing opening of the elevator body sections.

BRIEF DESCRIPTION OF THE DRAWINGS

The above and other features and objects of the invention will be better understood from the following detailed description of the typical embodiments illustrated in the accompanying drawings, in which:

FIG. 8 is a fragmentary view taken primarily on line 8—8 of FIG. 2 and showing the latch element for holding the two body sections of the elevator in closed condition, with certain portions of the elevator being omitted for clarity;

FIG. 9 is a fragmentary horizontal section taken on line 9—9 of FIG. 8 and showing the latch mechanism in closed condition;

FIG. 10 is a view similar to FIG. 9, but showing the latch and its lock element in open condition;

DESCRIPTION OF THE PREFERRED EMBODIMENTS

Figure 1:
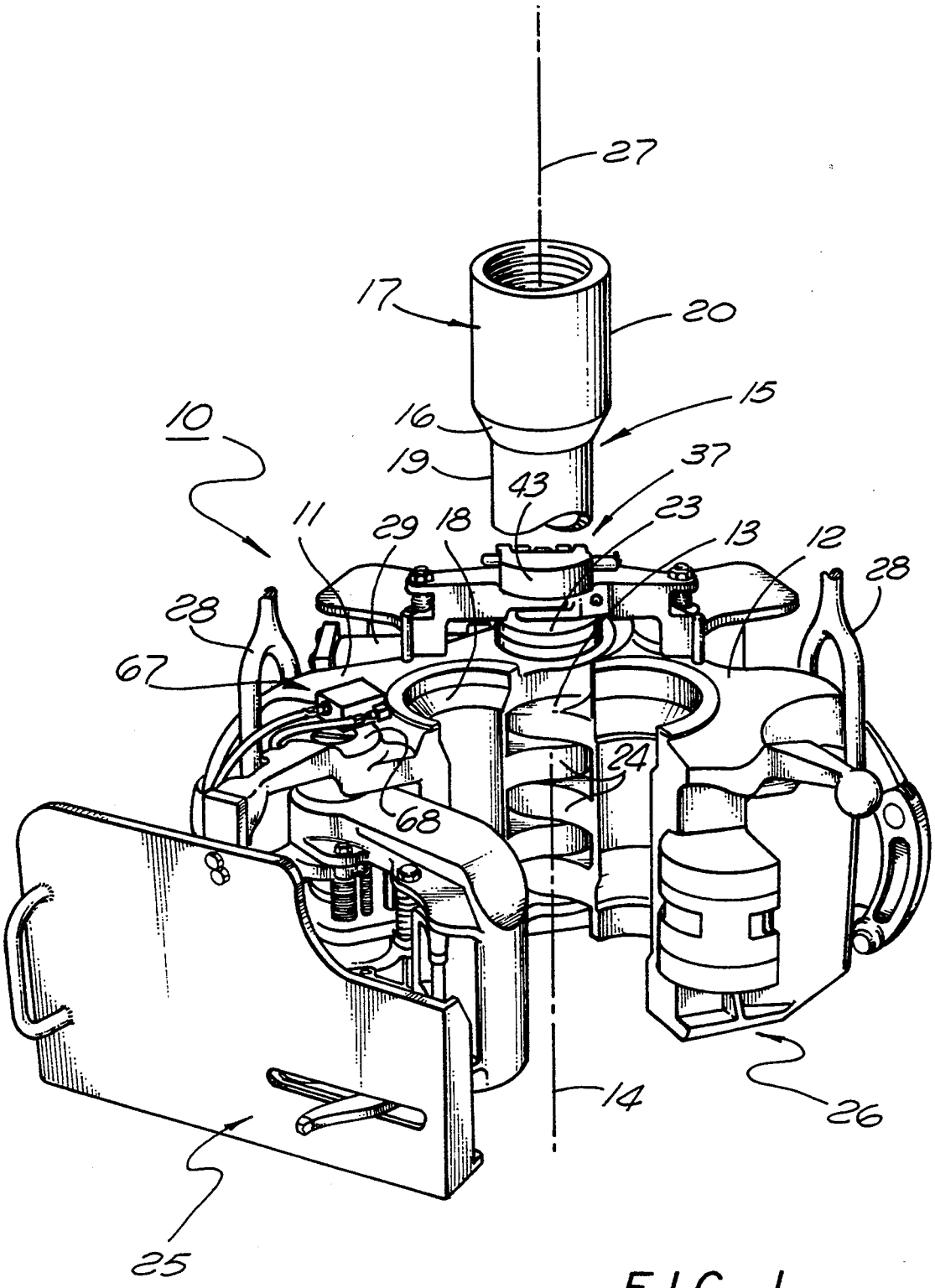
FIG. 1 is a perspective view of an air operated elevator having a safety valve embodying the invention, and with the elevator shown in open condition for movement laterally onto and off of a pipe.
Figure 2:
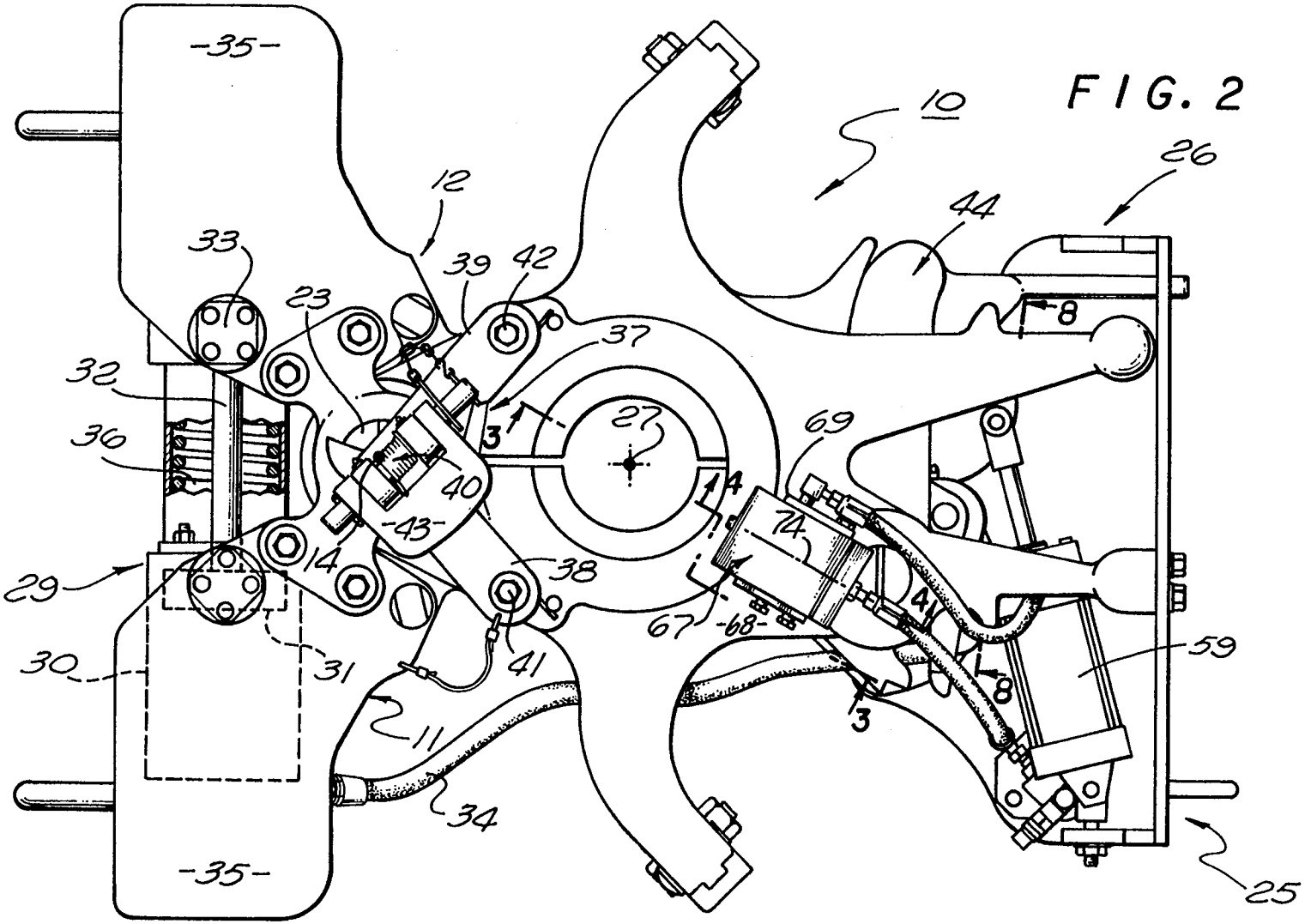
FIG. 2 is an enlarged plan view of the elevator of FIG. 1, shown in closed condition.
Figure 3:
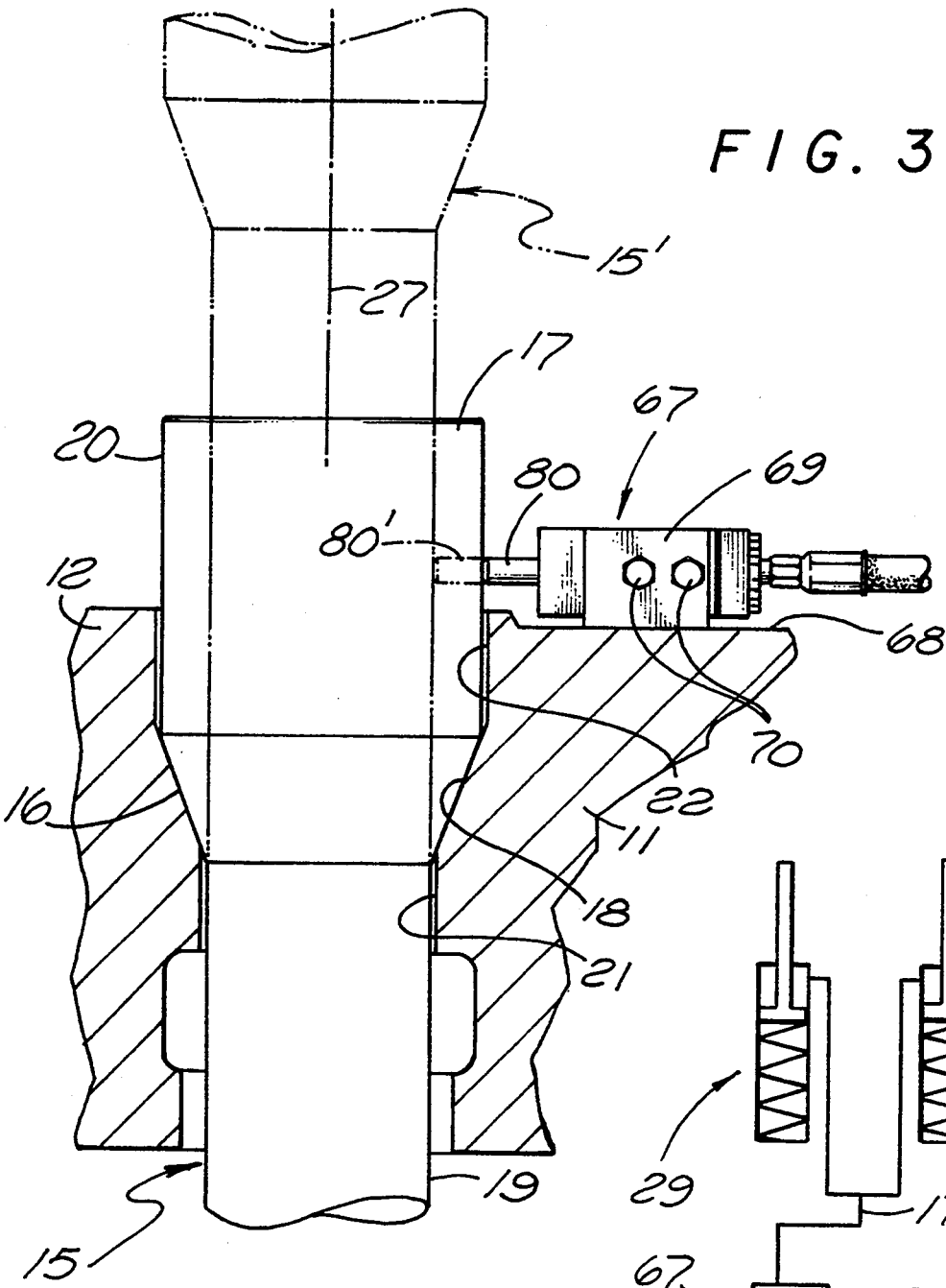
FIG. 3 is an enlarged fragmentary vertical section taken primarily on line 3—3 of FIG. 2.

Referring first to FIGS. 1 and 2, the elevator 10 shown in those figures includes two body sections 11 and 12 interconnected by a hinge 13 for relative swinging movement about a vertical axis 14 relative to one another between the open condition of FIG. 1 and the closed condition of FIG. 2. In the FIG. 2 condition, the elevator acts to support a well pipe 15 (see FIG. 3) having a downwardly tapered eighteen degree external surface 16 on its enlarged joint end 17 engaged by correspondingly downwardly conically tapered complementary eighteen degree support surfaces 18 formed within body sections 11 and 12. As seen in FIG. 3, pipe 15 has an external cylindrical surface 19 beneath tapered surface 16, and the enlarged joint end 17 has an external surface 20 above tapered surface 16. Body sections 11 and 12 of the elevator have lower reduced diameter cylindrical surfaces 21 which are spaced slightly from surface 19 of the drill pipe in the FIG. 3 position of that pipe, and have larger diameter cylindrically curved surfaces 22 which are spaced slightly from external surface 20 of the joint end.

The hinge connection 13 between body sections 11 and 12 of the elevator includes a cylindrical vertically extending hinge pin 23 received within hinge lugs 24 formed on the two body sections to interconnect the sections for opening and closing swinging movement about vertical axis 14. In the open condition of FIG. 1, the outer ends 25 and 26 of the two body sections 11 and 12 are spaced apart far enough to allow the elevator to be moved horizontally between a position about the pipe 15 and a position at a side of the pipe offset from the vertical axis 27 of the pipe string. The elevator may be supported in a drilling rig by conventional links 28 suspended at their upper ends from the vertically movable traveling block of the rig. In some instances, links 28 may be supported from the traveling block indirectly through a top drive unit including a motor which turns pipe 15 and a drill string connected thereto during a drilling operation.

Body sections 11 and 12 of elevator 10 are power actuated from their closed condition of FIG. 2 to their open condition of FIG. 1 by a piston and cylinder mechanism 29 including a cylinder 30 connected to section 11 (see FIG. 2) and a piston 31 having a piston rod 32 pivotally connected at 33 to body section 12 of the elevator. Piston 31 is actuable relative to cylinder 30 by pressure fluid, preferably compressed air, delivered to the cylinder through a hose 34. As will be understood, piston and cylinder mechanism 29 acts to pull the left end portions 35 of the body sections 11 and 12 as viewed in FIG. 2 together, thereby opening the right ends of those body sections for movement onto or off of a well pipe. The body sections are yieldingly urged to their closed condition of FIG. 2 by a spring represented as a coil spring 36 urging the left end portions 35 of the body sections as seen in FIG. 2 relatively apart.

When the body sections are actuated to their open condition by piston and cylinder mechanism 29, they are automatically retained in that open condition by an overcenter linkage mechanism 37 of known construction, including two links 38 and 39 having first ends pivotally connected together at 40, and having second ends connected pivotally to the two body sections 11 and 12 respectively at 41 and 42. When the elevator is closed, the pivotal connection at 40 between links 38 and 39 is offset to the left of a line extending between pivotal axes 41 and 42 at the ends of the links, and when the body sections 11 and 12 are opened to their FIG. 1 condition the pivotal connection at 40 between links 38 and 39 is spring urged rightwardly by a spring within mechanism 37 to an overcenter position rightwardly beyond the line extending between pivotal axes 41 and 42, to thereby act as an overcenter lock retaining the elevator sections 11 and 12 in open condition. When the elevator is subsequently moved laterally onto the well pipe, the pipe engages an actuator lug 43 carried by link 39 at the location of the pivotal connection 40 between the two links, to automatically deflect the overcenter mechanism leftwardly in FIG. 2 toward the position represented in that figure and thereby release body sections 11 and 12 for closing movement by spring 36.

The body sections 11 and 12 are held in closed condition by a latch 44 (see FIGS. 8 through 10) which is connected to the outer free end 25 of section 11 by a vertical pin 45 for limited swinging movement relative to body section 11 about a vertical axis 46 parallel to the well axis. As seen best in FIG. 10, body section 12 of the elevator has a latch lug 47 projecting outwardly from its extremity 26 and which is adapted to be received within an opening 48 in latch element 44 to hold the body sections in closed condition. As seen in FIG. 8, the lug receiving opening 48 in latch 44 is defined by parallel upper and lower portions 49 of latch 44 and a vertically extending portion 50 interconnecting portions 49 and having a latching surface 51 engageable with surface 52 of lug 47 to hold the sections closed.

Latch 44 is adapted to be locked in its FIG. 9 position by a hook shaped locking element 53 receivable within a recess 54 formed in lug 47 to interfit in locking relation with a pin 55 carried by the lug within recess 54. Element 53 is connected to latch 44 by a vertical pin 56 for limited relative pivotal movement about a vertical axis 57 between the locking position of FIG. 9 and the released position of FIG. 10, with a spring 58 yieldingly urging locking element 53 pivotally about axis 57 to its FIG. 9 position.

The latch 44 and its locking element 53 are power actuated to their open condition of FIG. 10 by a second piston and cylinder mechanism 59 whose cylinder 60 is attached pivotally to body section 11, and whose piston is connected pivotally at 61 to the outer end of locking element 53. In the FIG. 10 condition, the hook shaped extremity of element 53 is received within the recess 62 in portion 50 of the latch, with the movement of element 53 being limited by engagement of that element with a wall 63 of recess 62. It will thus be apparent that, upon fluid actuation of piston and cylinder mechanism 59 to urge the pivotal connection at 61 leftwardly from the FIG. 9 position, element 53 first swings through a limited angle relative to latch 44 to move the hook shaped portion of element 53 away from locking engagement with pin 55, after which subsequent actuation of the piston acts to swing latch 44 from its latching position of FIG. 9 to its open position of FIG. 10, thereby releasing sections 11 and 12 for opening movement. When, the fluid pressure is released from piston and cylinder mechanism 59, latch 44 is returned to its FIG. 8 position relative to body section 11 by a spring represented at 64, and locking element 53 is returned toward its FIG. 9 position relative to the latch 44 by its spring 58. Upon relative closing movement of body sections 11 and 12, curved camming surfaces 65 on lug 47 and latch 44 act to deflect the latch outwardly enough to pass the lug into recess 48 in the latch. Also, camming surface 66 on element 53 engages pin 55 in a relation deflecting element 53 to move past the pin and to its FIG. 9 locked position.

Figure 7:
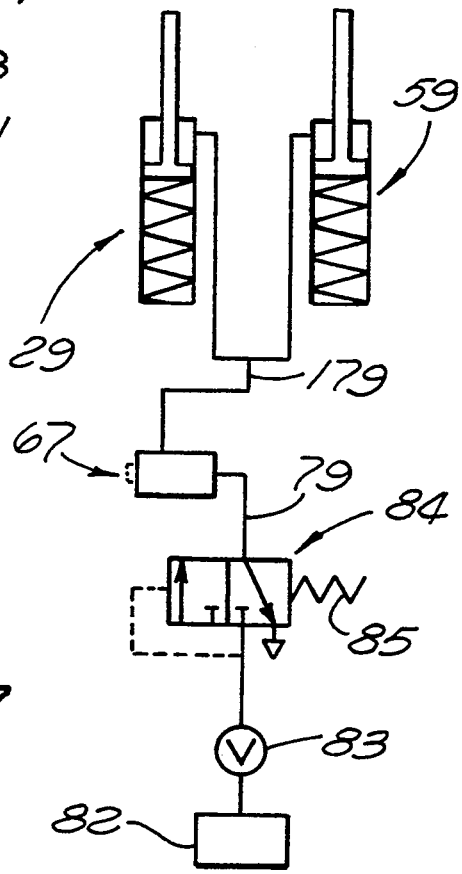
FIG. 7 is a schematic representation of the air delivery system for the elevator.
Figure 4:
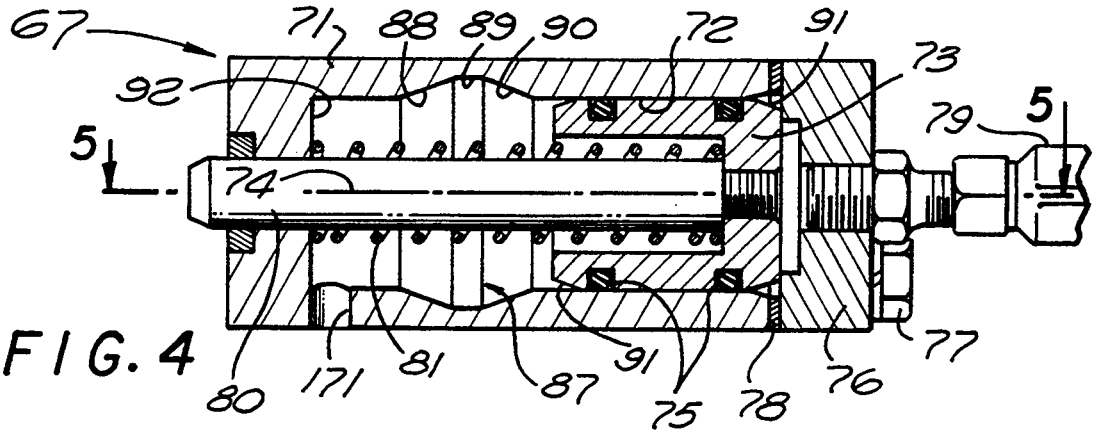
FIG. 4 is an enlarged fragmentary vertical section through the safety valve taken on line 4—4 of FIG. 2.

The elevator structure thus far described is known in the art. The present invention relates particularly to the provision in such an elevator of apparatus for preventing accidental opening of the elevator when a pipe is supported in the elevator. To attain that purpose, we utilize a safety valve 67 which controls the delivery of actuating pressurized air to jaw opening cylinder 29 and to latch releasing cylinder 59, and prevents delivery of such air to those cylinders when a pipe is supported in the elevator. Valve 67 may be connected to the upper surface 68 of body section 11 by a U-shaped bracket 69 appropriately attached to body section 11 and connected to valve 67 by bolts 70. As seen in FIG. 4, valve 67 includes a main body 71 containing a cylindrical bore 72 within which a piston 73 is movable along an axis 74. Spaced O-rings 75 carried by the piston form fluid tight annular seals within the valve body. A cover or end wall 76 is secured to the right end of body 71, as by bolts represented at 77, and is sealed with respect to valve body 71 by a gasket 78 extending about the bore. An air supply hose 79 delivers compressed air to the right end of bore 72, to urge piston 73 and its piston rod 80 leftwardly along axis 74 against the resistance of a coil spring 81 disposed about rod 80. The air pressure supplied to line 79 comes from a source represented diagrammatically at 82 in the schematic diagram of FIG. 7, and is turned on and off by a manually actuated control valve 83. A quick release valve 84 connected into the line between valve 83 and safety valve 67 is actuated automatically against the tendency of an internal spring 85 to pass air from valve 83 to valve 67 when valve 83 is opened. When valve 83 is closed, spring 85 returns valve 84 to the condition illustrated in FIG. 7, in which air from line 79 is bled to atmosphere to release the pressure in that line. This drop in pressure in line 79 enables spring 81 to return piston 73 rightwardly to its FIG. 4 position closing off communication between the right side of piston 73 and line 179 leading to cylinders 29 and 59. As piston 73 moves to the right, it permits air from cylinders 29 and 59 and line 179 to flow to the left side of piston 73 and out to atmosphere through an exhaust opening 171 at the left end of bore 72. In the FIG. 6 position of piston 73, such communication between line 179 and opening 171 is closed off by engagement of the left one of the two O-rings 75 with cylindrical bore 72 to the left of the enlarged portion 87 of that bore.

Figure 5:
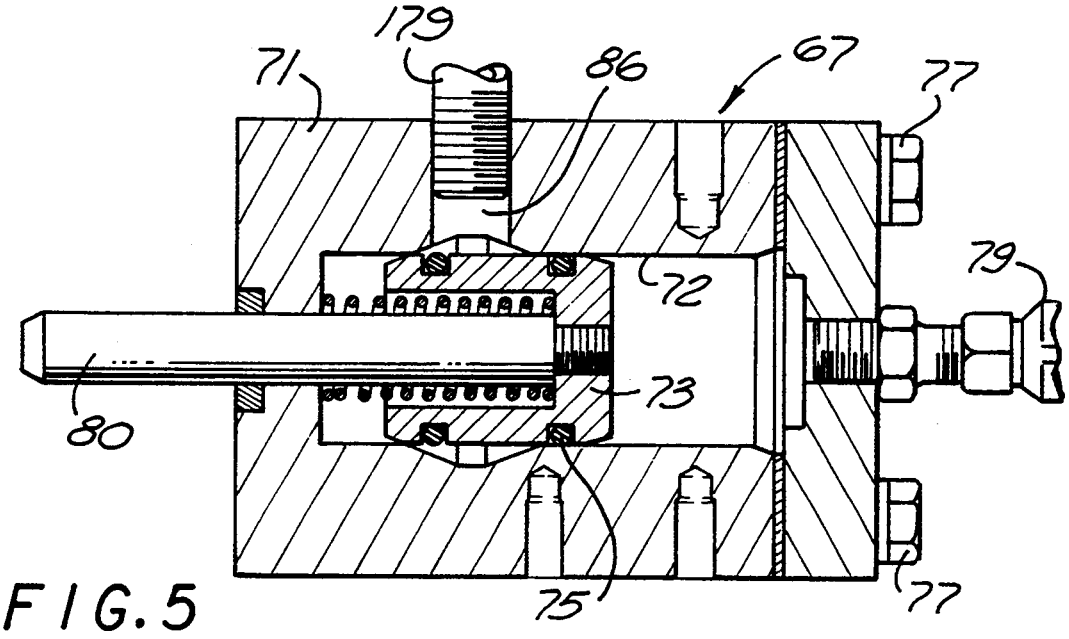
FIGS. 5 and 6 are horizontal sections taken on line 5—5 of FIG. 4 and showing the safety valve in two different positions.
Figure 6:
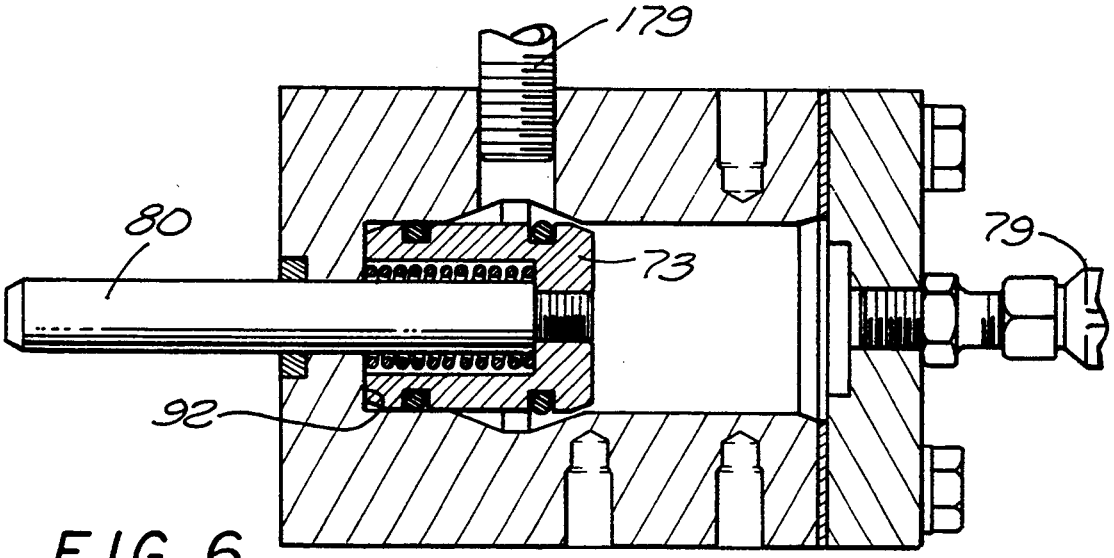

As seen in FIG. 5, the line 179 which leads air from the interior of bore 72 in valve 67 to cylinders 29 and 59 communicates through a passage 86 in valve body 71 with an enlarged diameter portion 87 of the chamber contained within body 71. This enlarged diameter portion 87 of the chamber in body 71 may be defined by a conically tapering surface 88 centered about axis 74 and extending from the diameter of bore 72 to the diameter of a short cylindrical surface 89 centered about axis 74, and by another conically tapered surface 90 at the opposite side of surface 89. Piston 73 has similarly conically tapering surfaces 91 at its opposite ends centered about axis 74. When piston 73 is in its extreme left hand position of engagement with end wall 92 of bore 72, as seen in FIG. 6, the tapered surface 91 at the right end of piston 73 is spaced slightly from the radially opposite tapered internal surface 90 in valve body 71, to allow air to flow from the right side of piston 73 through the narrow annular gap between surfaces 91 and 90 and thus to line 179 leading to piston and cylinder mechanisms 29 and 59, to release latch 44 and open elevator sections 11 and 12.

Valve 67 is positioned on body section 11 with axis 74 of the valve extending radially of the main vertical axis 27 of the elevator and a pipe contained therein. Thus, piston 73 and its rod 80 are movable radially toward and away from that axis, and toward and away from the outer surface 20 of a pipe contained within the elevator. When a pipe 15 is located in the elevator and supported thereby in the position illustrated in FIG. 3, engagement of rod 80 with the outer surface 20 of the enlarged upper joint end 17 of the pipe limits movement of rod 80 in the position illustrated in full lines in FIG. 3. In that position, piston 73 is located as illustrated in FIG. 5, with the right hand one of the two O-rings 75 still in engagement with bore 72 at the right side of the enlarged portion 87 of the chamber in the valve body, to thus prevent the flow of any of the actuating air from the right side of piston 73 past that piston to line 179 and the operating cylinders 29 and 59 of the elevator. If the pipe 15 of FIG. 3 is in a higher position such as that represented in broken lines at 15' in FIG. 3, rod 80 of valve piston 73 is then allowed to move farther toward the axis of the pipe to the broken line position 80' and into engagement with the reduced diameter portion 19 of the pipe beneath its upper joint end 17. In that condition, piston 73 is almost in engagement with but preferably spaced slightly from end wall 92 of valve body 71, and the right end of the piston is at the location represented in FIG. 6, in which position air can flow past the right end of the piston and into the enlarged portion 87 of the valve body and then to line 179 and cylinders 29 and 59. The air is thus permitted to open the elevator when rod 80 of valve 67 is in engagement with the reduced diameter portion of pipe 15, in which condition the pipe is not supported by the elevator and there is no danger of dropping a supported string into the well. The valve 67 can not, however, permit opening of the elevator when rod 80 is in engagement with the enlarged diameter surface 20 of the upper joint end 17 of the pipe.

Figure 11:
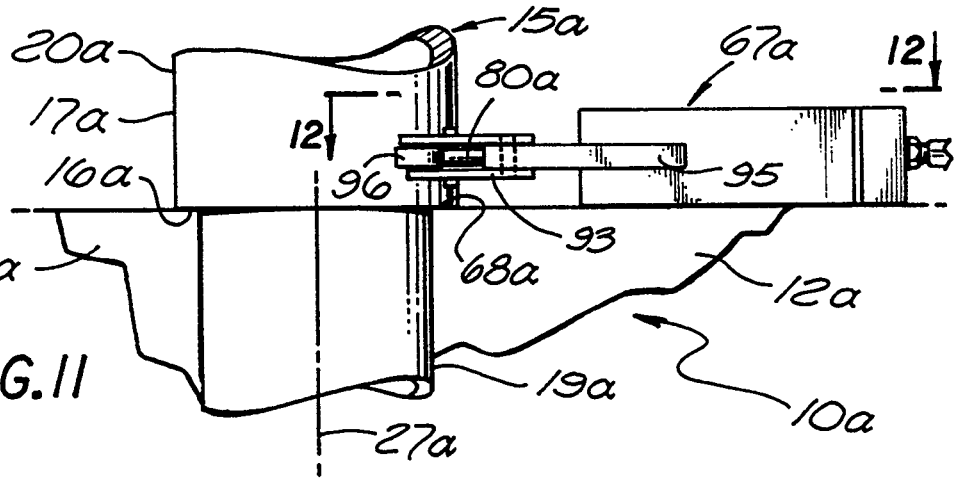
FIG. 11 is a fragmentary view similar to FIG. 3 but showing a variational type of elevator for supporting a different type of well pipe in the elevator.
Figure 12:
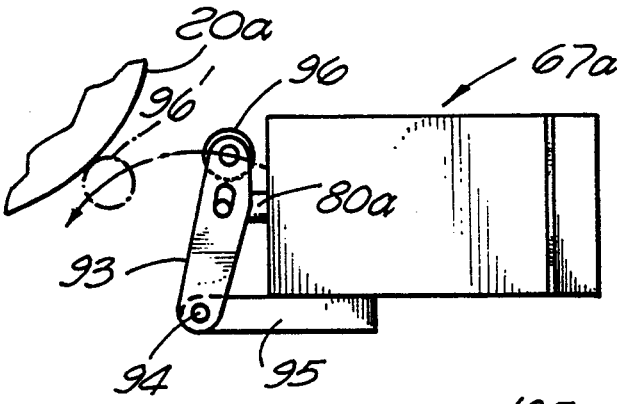
FIG. 12 is a fragmentary plan view of the safety valve of FIG. 11, taken generally on line 12—12 of FIG. 11 but with the pipe contacting roller in retracted position rather than the extended position of FIG. 11.

FIG. 11 illustrates application of the invention to a variational type of elevator **10*a* which may be considered as identical with that shown in FIGS. 1 to 10 except that the elevator of FIG. 11 is adapted for support of a different type of well pipe 15*a* in lieu of the eighteen degree tapered pipe of FIG. 3. In FIG. 11, the main body of the pipe 15*a* has an external cylindrical surface 19*a* corresponding to surface 19 of the FIG. 3 pipe, but the upper joint end 17*a* corresponding to the upper end 17 of the FIG. 3 pipe does not have the tapered support surface 16, but rather has a horizontally extending annular downwardly facing shoulder surface 16*a* engageable with the upper surface 68*a* of body sections 11*a* and 12*a*. Safety valve 67*a* of FIG. 11 may be essentially the same as valve 67 of FIGS. 4 to 6, but with the rod 80*a* of valve 67*a* being typically connected to an arm 93 (see FIG. 12) which is pivoted at 94 to a mounting bracket 95 connected to the body of valve 67*a*. At its second end, arm 93 carries a roller 96, which can swing from the retracted position illustrated in full lines in FIG. 12 to either of two extended positions of engagement with the outer surface of the pipe. When roller 96 is in engagement with the outer surface 20*a* of the enlarged portion of pipe 15*a* (broken line position 96' of FIG. 12 and full line position of FIG. 11), the valve piston within valve 67*a* is in the position represented in FIG. 5, to prevent the delivery of actuating air to the elevator opening and unlatching cylinders. If the pipe 15*a* of FIG. 11 is in a higher position in which roller 96 engages the reduced diameter surface 19*a* of the pipe, with the pipe no longer being supported by the elevator, arm 93 is then permitted to swing farther inwardly toward axis 27*a* of the pipe, and in that condition the valve piston is in the position of FIG. 6 permitting delivery of actuating air to line 179 and cylinders 29 and 59**.

Figure 13:
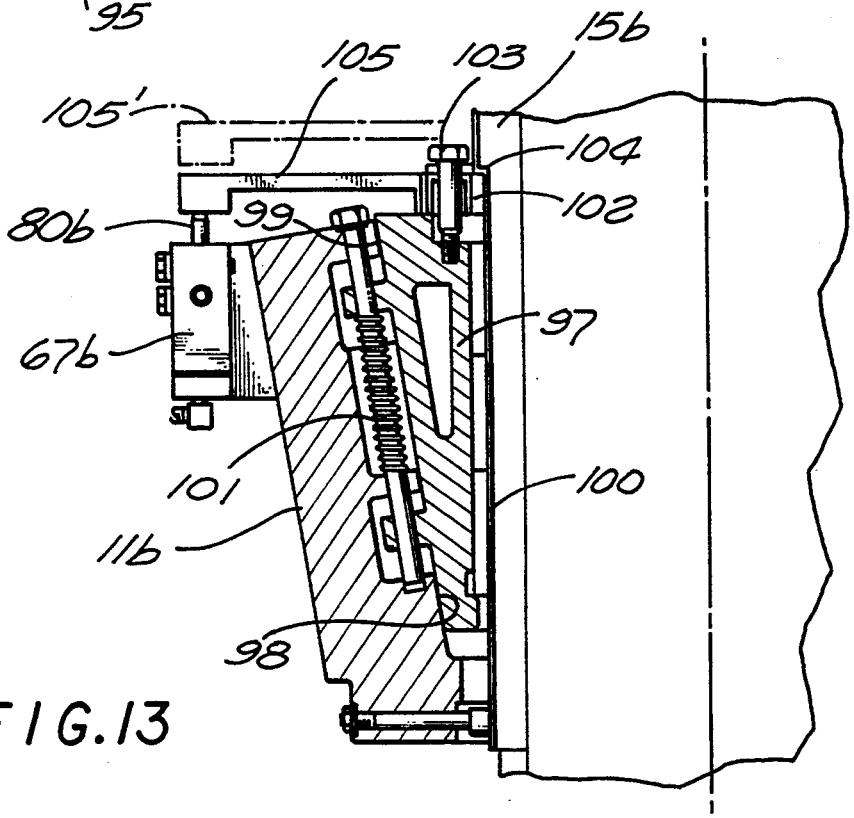
FIG. 13 is a fragmentary vertical section which may be considered as similar to FIGS. 3 and 11 but showing adaptation of the invention to a slip type air operated elevator.

FIG. 13 is an enlarged vertical section through a variational type of elevator which may be identical to that shown in FIGS. 1 through 10 except that the pipe **15*b* is supported in the elevator by slip elements 97 rather than by the tapered support surfaces 18. As in FIGS. 1 to 10, the elevator of FIG. 13 includes two body sections corresponding to sections 11 and 12 of FIGS. 1 to 10 adapted to be opened and closed and latched by cylinders such as those represented at 29 and 59. One of the two body sections is illustrated at 11*b* in FIG. 13. That body section has a downwardly tapering inner slip bowl surface 98 engageable with correspondingly downwardly tapered external surfaces 99 on slips 97, to cam the slips inwardly against pipe 15***b* upon downward movement of the slips. The inner gripping surfaces 100 of the slips act to tightly hold the pipe and support it in the well. Spring 101 resists downward movement of the slips and a ring 102 connected by bolts 103 to the slips 97 within body 11*b* and to corresponding slips carried by the second of the two relatively openable and closeable body sections. When a shoulder 104 on pipe 15*b* engages ring 102 and displaces it downwardly as the well pipe is supported by the slips, ring 102 moves a radially outwardly projecting arm 105 downwardly to press the vertically extending rod 80*b* of a safety valve 67*b* downwardly. Valve 67*b* may be constructed in the same manner as valve 67 of FIG. 4, and be so located relative to ring 102 and arm 105 as to close off the flow of air to cylinders 29 and 59 when a pipe is supported by slips 97 (full line position of FIG. 13), and open the safety valve 67*b* for delivery of fluid to pistons 29 and 59 when pipe 15*b* has been raised and arm 105 is correspondingly elevated by spring 101 to the broken line position represented at 105' in FIG. 13. When a pipe is supported in slips 97 and arm 105 is in its full line position of FIG. 13, the valve element 73 of valve 67*b* is in the position of FIG. 5. When arm 105 is allowed to rise to the broken line position 105' of FIG. 13, valve element 73 is in the position of FIG. 6, permitting air to flow to the actuating cylinders 29 and 59.

While certain specific embodiments of the present invention have been disclosed as typical, the invention is not limited to these particular forms, but rather is applicable broadly to all such variations as fall within the scope of the appended claims.

We claim:

1. An elevator, comprising:

a plurality of elevator sections relatively movable between a closed condition for supporting a pipe and an open condition for movement onto and off of the pipe;

means for power actuating said sections between closed and open conditions; and means automatically responsive to the presence of a pipe at a location to be supported by said sections to prevent accidental opening of the sections by said actuating means;

said actuating means being operable by pressure fluid to move the elevator sections relatively between closed and open positions;

said automatically responsive means including a valve body through which pressure fluid is delivered to said actuating means and having a fluid inlet and an outlet leading to said actuating means, and a valve piston movable slidably within said valve body from a first position to a second position by pressure fluid delivered to a predetermined side of the piston through said inlet;

said piston in said first position preventing flow of pressure fluid from said side of the piston to said outlet, and in said second position passing fluid to the outlet and said actuating means;

said automatically responsive means including a sensing element movable with the valve piston and operable to sense the presence of a pipe at a location for support by said sections and acting to prevent movement of the valve piston to said second position when a pipe is so located.

2. An elevator as recited in claim 1, in which said valve body has an exhaust outlet to atmosphere which is in communication with said first mentioned outlet in said first position of the valve piston and is closed off by the valve piston from communication with the first mentioned outlet in said second position of the valve piston.

3. An elevator as recited in claim 2, including a spring yieldingly urging said valve piston to said first position thereof.

4. An elevator as recited in claim 3, in which said sensing element is a rod projecting from said valve piston and movable with the piston toward and away from the axis of a pipe located in the sections and which is prevented from movement to said second position of the valve piston by engagement with an enlarged joint end of the pipe.

5. An elevator as recited in claim 3, including latch means for releasably retaining said sections against opening movement, said actuating means including a first unit receiving fluid from said first mentioned outlet of the valve body and operably by such fluid to actuate said sections from closed to open condition, and a second unit also receiving fluid from said valve body in said second position of the valve piston and operably by such fluid to release said latch means.

6. An elevator as recited in claim 3, in which said elevator sections include body parts and slip elements carried by said body parts for limited relative upward and downward movement to support a pipe, said sensing element being a rod projecting from said valve piston and movable essentially vertically with said piston and responsive to movement of the slip elements downwardly by a supported pipe to prevent movement of the valve piston to said second position thereof.

7. An elevator as recited in claim 1, including a control valve controlling the delivery of pressure fluid to said inlet of the valve body, and a quick release valve between said control valve and said inlet of the valve body for relieving pressure from said side of the valve piston upon closure of said control valve.

8. An elevator assembly comprising:

a plurality of elevator sections relatively movable between a closed condition for supporting a pipe and an open condition for movement onto and off of the pipe;

yielding means urging said sections to said closed condition to hold a pipe;

actuating means operable by pressure fluid received from a supply line to actuate said sections from closed condition to open condition against the tendency of said yielding means to release the pipe; and safety valve means automatically responsive to the presence of a pipe at a location to be supported by said sections to close off the delivery of pressure fluid from said supply line to said actuating means and thereby prevent accidental opening of the sections by said actuating means.

9. An elevator assembly as recited in claim 8, in which said safety valve means include a sensing element carried by said sections for movement toward and away from the axis of a pipe located in the sections and whose movement toward the axis is limited by engagement of the element with an enlargement on the pipe when the pipe is positioned for support by said sections, said safety valve means being operable automatically to close off the delivery of pressure fluid to said actuating means and thereby prevent accidental opening of the sections when the movement of said sensing element toward said axis is limited by engagement with said enlargement on the pipe.

10. An elevator assembly as recited in claim 8, in which said elevator sections have inner downwardly tapering surfaces for supporting a pipe having a correspondingly tapered surface and an enlarged diameter cylindrical external surface thereabove, said safety valve means including a sensing element mounted for movement toward and away from the axis of a pipe in the elevator sections and positioned to engage said cylindrical surface of a pipe supported by said tapering surfaces of the sections in a relation limiting movement of the sensing element toward said axis, said safety valve means being operably automatically to close off the delivery of pressure fluid to said actuating means and thereby prevent accidental opening of the sections when said sensing element is in engagement with said cylindrical surface.

11. An elevator assembly as recited in claim 8, in which said sections have essentially horizontal upwardly facing support surfaces for supporting a pipe having a relatively small diameter portion received within the sections and having an enlarged diameter flange received above said surfaces and engageable downwardly thereagainst, said safety valve means including a sensing element mounted to said sections for movement toward and away from a pipe located in the sections and positioned to engage said flange of a supported pipe in a relation limiting movement of the sensing element toward said pipe, said safety valve means being operable automatically to close off the delivery of pressure fluid to said actuating means and thereby prevent accidental opening of the sections when said element is in engagement with said flange.

12. An elevator assembly as recited in claim 8, in which said elevator sections include body parts and slip elements carried by said body parts for limited relative upward and downward movement to support a pipe, said safety valve means including a sensing element mounted movably to the sections;

said safety valve means being operable automatically by said sensing element in response to movement of the slip elements downwardly by a supported pipe to close off the delivery of pressure fluid to said actuating means and thereby prevent opening of the sections.

13. An elevator as recited in claim 8, including latch means for releasably retaining said sections against opening movement, said actuating means including a first unit operable by pressure fluid to actuate said sections relative to one another from closed condition to open condition, and a second unit operable by pressure fluid to release said latch means, said safety valve means being operable automatically to prevent the delivery of pressure fluid to said first unit and to said second unit when a pipe is at a location to be supported by said sections.

14. An elevator assembly comprising:

a plurality of elevator sections relatively movable between a closed condition for supporting a pipe and an open condition for movement onto and off of the pipe;

actuating means operable by pressure fluid to actuate said sections from closed condition to open condition to release the pipe;

a first valve for controlling the delivery of pressure fluid from a source to said actuating means and actuable between open and closed conditions; and safety valve means operable automatically in response to the presence of a pipe at a location to be supported by said sections to close off the delivery of pressure fluid from said first valve to the actuating means and thereby prevent accidental opening of the sections by said actuating means.

15. An elevator assembly as recited in claim 14, in which said safety valve means include a sensing element carried by the sections for movement generally toward and away from the axis of a pipe supported by the sections and engageable with an enlargement on the pipe to limit movement of the sensing element, said safety valve means being automatically responsive to engagement of said sensing element with said enlargement on the pipe to prevent delivery of pressure fluid to said actuating means.

16. An elevator assembly as recited in claim 14, in which said elevator sections include body parts and slip elements movable upwardly and downwardly relative to the body parts to support a pipe, said safety valve means including a sensing element actuable by said slip elements upon downward movement of the slip elements relative to said body parts, and said safety valve means being automatically responsive to actuation of said sensing element by said slip elements to prevent delivery of pressure fluid to said actuating means and thereby prevent opening of the sections when a pipe is supported by the slip elements.

* * * * *